US009663895B2

(12) United States Patent
Nunn et al.

(10) Patent No.: US 9,663,895 B2
(45) Date of Patent: May 30, 2017

(54) PROCESS FOR APPLICATION OF CHEMICALS ON TEXTILE MATERIALS DURING THE REJUVENATION PROCESS

(71) Applicants: Kayren Joy Nunn, Bixby, OK (US); Susan Hughes Brown, Bixby, OK (US)

(72) Inventors: Kayren Joy Nunn, Bixby, OK (US); Susan Hughes Brown, Bixby, OK (US)

(73) Assignee: PSIL HOLDINGS LLC, Tulsa, OK (US)

( * ) Notice: Subject to any disclaimer, the term of this patent is extended or adjusted under 35 U.S.C. 154(b) by 0 days.

(21) Appl. No.: 14/672,147

(22) Filed: Mar. 28, 2015

(65) Prior Publication Data

US 2016/0281292 A1 Sep. 29, 2016

(51) Int. Cl.

| | |
|---|---|
| ***D06L 1/04*** | (2006.01) |
| ***D06L 1/00*** | (2017.01) |
| ***D06L 1/06*** | (2006.01) |
| ***D06B 1/00*** | (2006.01) |
| ***D06L 1/22*** | (2006.01) |
| ***D06L 4/40*** | (2017.01) |

(52) U.S. Cl.

CPC ..... *D06L 1/04* (2013.01); *D06B 1/00* (2013.01); *D06L 1/00* (2013.01); *D06L 1/06* (2013.01); *D06L 4/40* (2017.01)

(58) Field of Classification Search

CPC ..... D06L 1/04; D06L 1/00; D06L 1/06; D06L 1/22; D06L 4/40; C11D 3/386; C11D 11/0017; D06B 1/00

See application file for complete search history.

(56) References Cited

U.S. PATENT DOCUMENTS

| | | | | |
|---|---|---|---|---|
| 4,056,675 | A | 11/1977 | Turbak | |
| 4,086,418 | A | 4/1978 | Turbak | |
| 5,481,864 | A | 1/1996 | Wright | |
| 6,378,179 | B1 * | 4/2002 | Hirsch | D04H 1/4274 19/107 |
| 2011/0094691 | A1 * | 4/2011 | Nunn | D21B 1/04 162/4 |

* cited by examiner

*Primary Examiner* — Amina Khan

(74) *Attorney, Agent, or Firm* — Andrews Kurth LLP; David Bradin

(57) ABSTRACT

The present invention relates to a process for application of chemicals on textile materials for removing surface chemicals and finishes from textile materials which comprises the following steps: reducing the textile materials to an appropriate size; applying a first catalyzed vapor to the textile materials at a predetermined temperature; penetrating the textile materials at a predetermined temperature; applying a second catalyzed vapor to the textile materials; blending the textile materials; applying a third catalyzed vapor to the textile materials in the one or more blending boxes and dwelling the fabric at a predetermined temperature for a predetermined period of time; and applying a blast of cool air to the one or more blending boxes to stop chemical actions in the textile materials and then transporting the textile materials to next station for further deconstruction processing.

11 Claims, No Drawings

PROCESS FOR APPLICATION OF CHEMICALS ON TEXTILE MATERIALS DURING THE REJUVENATION PROCESS

TECHNICAL FIELD

The present invention relates generally to a process that supports the "Method and System of Processing Waste Fabrics to Rejuvenate Fibrous Materials" in the rejuvenation of textile waste to cleanse surface chemicals from textile materials.

BACKGROUND ART

Of primary importance in the art of fiber rejuvenation is the ability to restore fabric to a new state.

All fabrics, which are considered for rejuvenation, have gone through a series of chemical treatments prior processing for end use whether their origin is post-industrial scrap from textile cutting room floors, non-woven scrap cuttings, yarns from spinners or previously used textiles. These chemical processes may be as simple as a bleaching technique or as complex as starches or chemicals which set color and/or change texture, as well as intricate finishes which improve overall fabric performance such as ballistic finishes, flame retardants, silicones, cool technology and the like. When creating fibers of like quality from these scrap materials, it is important to bring them back to a virgin state by cleansing the surface chemicals from the fabric pieces.

Traditional means of cleansing fabrics for continued production are systems that "wash and dry" the fabrics, yarn or materials such as large vats for immersion or industrial washing machines followed by commercial gas or electric drying methods. Typical wash-and-dry methodology has proven to be environmentally hazardous and unsustainable. Moreover, wash-and-dry treatments add unnecessary cost to the process. In a wash-and-dry method described in U.S. Pat. No. 6,378,179, enzymes are applied either by means of a high pressure wash or a bath in order to alter the surface properties of the fibers and render them hydrophilic if high absorbency is required in a hydroentangled product. Not only is this procedure extremely harsh to the fibers, but the resources expended in water and energy (process speed, appropriate drying, etc.) makes this approach costly and environmentally unsustainable. Yet another disadvantage to the wash-and-dry method is that many fibers such as rayon, kapok, silk and PLA are unable to sufficiently tolerate water baths, however, the fact remains that their finishes must still be removed.

DISCLOSURE OF THE INVENTION

It is an object of the present invention to provide a process for application of chemicals on textile materials for removing surface chemicals and finishes from textile materials with a view to maintain the integrity of the fibers of the textile materials.

To attain this, the process for application of chemicals on textile materials for removing surface chemicals and finishes from textile materials of the present invention comprises the following steps:

(1) reducing the textile materials to an appropriate size;

(2) applying a first catalyzed vapor to the textile materials at a predetermined temperature to cleanse and strengthen the textile materials; the types of vapor used in CVC No. 1 could be a cellulase enzyme, a specialized organic surfactant, an organic or inorganic acid etc, depending on composition of the textile materials and finishes that have been applied to the textile materials;

(3) penetrating the textile materials, for example by means of two rotary drums having sleeves of industrials needles rotating counter clockwise, at a predetermined temperature to initially break surface bond of the textile materials so that chemicals of the catalyzed vapor can begin to divide molecules of the surface chemicals and finishes from multi directions;

(4) applying a second catalyzed vapor to the textile materials to further cleanse and strengthen the textile materials; the first catalyzed vapor and the second catalyzed vapor could be either identical or divergent;

(5) blending the textile materials in one or more blending boxes; more preferably, blending is conducted by a delivery condenser positioned over the one or more blending boxes and moving from left to right to deposit the textile materials into the one or more blending boxes in a z-type pattern until the one or more blending boxes are filled;

(6) applying a third catalyzed vapor to the textile materials in the one or more blending boxes and dwelling the fabric at a predetermined temperature for a predetermined period of time in the one or more blending boxes; the preferred temperature in the one or more blending boxes should be between 68 F and 120 F, with an ideal temperature of 88 F for cotton rich fabrics; the preferred period of time is between 45 minutes to 24 hours;

(7) applying a blast of cool air to the one or more blending boxes to stop chemical actions in the textile materials and then transporting the textile materials to next station for further deconstruction processing.

The first catalyzed vapor, the second catalyzed vapor and the third catalyzed vapor are each prepared from enzymatic and organic chemicals which remove starches, silicone finishes, fabric softeners, repellents, flame retardants, permanent press finishes, foamers, defoamers and soil release agents, among others; or PCA, acrylic sizing agents, oiling waxes, silicone based lubricants, or a combination of these.

In comparison of the prior art which uses high pressure wash or water bath to apply enzymes to the textile materials, the essence of the present invention is the application of the treatment compositions (i.e. the catalyzed vapor) in steam form, which could penetrate the very core of the textile materials for removing surface chemicals and finishes without damaging the fibers of the textile materials, and also causing less damage to the environment.

BEST MODE FOR CARRYING OUT THE INVENTION

The process of the subject invention is now described in detail with reference to an exemplary embodiment.

In this embodiment, the textile materials are first reduced to an appropriate size by a guillotine or similar cutter. As an example, the textile materials could be reduced to rectangular pieces of no wider than 6 inches and no longer than 8 inches; alternatively, the textile materials could be reduced to square pieces of no larger than 8 inches square. The reduced textile materials are then transferred by a conveyor to a first chamber in which a first catalyzed vapor is applied, e.g. by means of nozzles, to the textile materials to cleanse and strengthen the textile materials. Additionally, the emission of catalyzed vapor also promotes natural untwisting of the textile materials by relaxing and softening them, which eliminates fraying. Depending on the nature of the textile materials, the first catalyzed vapor used in the first chamber could be a cellulase enzyme, a specialized organic surfactant, an organic or inorganic acid etc and is emitted onto the textile materials via a catalytic steam chamber where the materials are carried thru the chamber gently on a motor driven perforated belt.

After the textile materials leave the first chamber, the textile materials are then conveyed to a second chamber in which the textile materials are penetrated by means of two rotary drums having sleeves of industrials needles rotating counter clockwise at a predetermined temperature to initially break surface bond of the textile materials so that chemicals of the catalyzed vapor can begin to divide molecules of the surface chemicals and finishes from multi directions. Unlike conventional rotary drums disposed with tearing pins to tear the textile materials apart and thus damage the fabric of the textile materials, the needles on the rotary drums of the present embodiment resemble knife blades which cut through to the yarn segments and dividing the yarn segments into long pieces of yarn. The second chamber may be provided with an external temperature gauge to constantly monitor the temperature of the second chamber, and the temperature of the second chamber may be adjusted by means of air, water or refrigerant, depending on the nature of the textile materials being processed. As an example, a thermostat may be disposed in the second chamber to monitor the temperature therein, and once the temperature of the second chamber exceeds a predetermined level, the temperature of the second chamber may be adjusted by means of air, water or refrigerant.

After the textile materials leave the second chamber, the textile materials are then conveyed to a third chamber in which a second catalyzed vapor is applied, e.g. by means of nozzles, to the textile materials to further cleanse and strengthen the textile materials. The first catalyzed vapor and the second catalyzed vapor could be either identical or divergent, depending on the nature of the textile materials being processed.

The textile materials are then transported, preferably by negative pressure, to a set of large blending boxes for blending. In this embodiment, the blending boxes are each approximately ten feet wide and forty feet long; blending is conducted by a delivery condenser positioned over the set of blending boxes and moving from left to right to deposit the textile materials into the set of blending boxes in a z-type pattern until the set of blending boxes are filled.

A third catalyzed vapor is then applied to the textile materials in the blending boxes. Again, the third catalyzed vapor could be either identical or divergent from the second catalyzed vapor. The textile materials are then dwelled at a predetermined temperature for a predetermined period of time in the one or more blending boxes to promote the continuous release of cured materials into the production process; the preferred temperature in the set of blending boxes should be between 68 F and 120 F, with an ideal temperature of 88 F for cotton rich fabrics; the preferred period of time is between 45 minutes to 24 hours.

At the end of the prescribed dwell time of the semi-dry removal of the surface chemistry there is a signal that the textile materials are to be moved to the next station. A blast of cool air is issued into the set of blending boxes to stop the action of the chemistry and the textile materials are removed with negative pressure from the area. As an example, when the textile materials are removed from the blending boxes to a PU coated ductwork, a refrigerated station which is placed at the beginning of the ductwork is configured to cool the textile materials. The textile materials then travel through PU coated ductwork to their next station for further deconstruction processing.

According to the above disclosure, a person skilled in the art may make suitable modifications and changes to the above embodiments. Therefore, the present invention is not limited by the above disclosure and the embodiment described. Modifications and changes to the present invention should fall within the scope of the present invention as defined by the claims. Besides, although certain technical terms have been used throughout the specification, the technical terms are intended for ease of explanation and are not intended to restrict the present invention in any ways.

The invention claimed is:

1. A process for applying chemicals on textile materials to remove surface chemicals and finishes from said textile materials which comprises the following steps:

(1) reducing the textile materials to an appropriate size;

(2) applying a first combination of enzymatic and organic chemicals to the textile materials at a predetermined temperature to cleanse and strengthen the textile materials;

(3) penetrating the textile materials at a predetermined temperature to initially break the surface bond of the textile materials so the combination of enzymatic and organic chemicals can begin to remove molecules of the surface chemicals and finishes from multi directions;

(4) applying a second combination of enzymatic and organic chemicals to the textile materials to further cleanse and strengthen the textile materials;

(5) blending the textile materials in one or more blending boxes;

(6) applying a third combination of enzymatic and organic chemicals to the textile materials in the one or more blending boxes and dwelling the fabric at a predetermined temperature for a predetermined period of time in the one or more blending boxes;

(7) applying a blast of cool air to the one or more blending boxes to stop chemical actions in the textile materials and then transporting the textile materials to a subsequent station for further deconstruction processing.

2. The process of claim 1, wherein in step (2), the first combination of enzymatic and organic chemicals comprises a cellulase enzyme.

3. The process as in claim 1, wherein in step (3), the textile materials are penetrated by means of two rotary drums having sleeves of industrials needles rotating counter clockwise.

4. The process as in claim 1, wherein in step (4), the first combination of enzymatic and organic chemicals and the second combination of enzymatic and organic chemicals can be either identical or divergent.

5. The process as in claim 1, wherein in step (5), blending is conducted by a delivery condenser positioned over the one or more blending boxes and moving from left to right to deposit the textile materials into the one or more blending boxes in a z-type pattern until the one or more blending boxes are filled.

6. The process as in claim 1, wherein in step (6), the third combination of enzymatic and organic chemicals can be either identical or divergent from the second combination of enzymatic and organic chemicals.

7. The process as in claim 1, wherein in step (6), the temperature in the one or more blending boxes is between 68 F and 120 F.

8. The process as in claim 1, wherein in step (6), the predetermined period of time is between 45 minutes to 24 hours.

9. The process as in claim 1, wherein the first combination of enzymatic and organic chemicals, the second combination of enzymatic and organic chemicals and the third combination of enzymatic and organic chemicals are each selected from the group consisting of enzymatic and organic chemicals which remove starches, silicone finishes, fabric softeners, repellents, flame retardants, permanent press finishes, foamers, defoamers and soil release agents; PCA (polycarboxylic acid), acrylic sizing agents, oiling waxes, silicone based lubricants, and combinations thereof.

10. The process of claim 2, wherein the first combination of enzymatic and organic chemicals further comprises an organic surfactant, an organic acid, or an inorganic acid.

11. The process of claim 7, wherein the textile is a cotton-rich fabric, and wherein the temperature in the one or more blending boxes is around 88° F.

* * * * *